US008339330B2

(12) United States Patent
Yun et al.

(10) Patent No.: US 8,339,330 B2
(45) Date of Patent: Dec. 25, 2012

(54) FREQUENCY SELECTIVE SURFACE STRUCTURE FOR MULTI FREQUENCY BANDS

(75) Inventors: So-Hyeun Yun, Daejon (KR); In-Bok Yom, Daejon (KR); Ho-Jin Lee, Daejon (KR); Ji-Whan Ko, Gyeongbuk (KR)

(73) Assignees: Electronics and Telecommunications Research Institute, Daejon (KR); Kumoh National Institute of Technology, Gyeongbuk (KR)

( * ) Notice: Subject to any disclaimer, the term of this patent is extended or adjusted under 35 U.S.C. 154(b) by 203 days.

(21) Appl. No.: 12/747,134

(22) PCT Filed: Jul. 18, 2008

(86) PCT No.: PCT/KR2008/004225

§ 371 (c)(1),
(2), (4) Date: Jun. 9, 2010

(87) PCT Pub. No.: WO2009/075449

PCT Pub. Date: Jun. 18, 2009

(65) Prior Publication Data

US 2010/0271285 A1 Oct. 28, 2010

(30) Foreign Application Priority Data

Dec. 10, 2007 (KR) ..... 10-2007-0127739

(51) Int. Cl.
*H01Q 15/14* (2006.01)

(52) U.S. Cl. ..... 343/912

(58) Field of Classification Search ..... 343/912, 343/909, 753–754, 700 MS
See application file for complete search history.

(56) References Cited

U.S. PATENT DOCUMENTS

| | | | | |
|---|---|---|---|---|
| 4,814,785 | A | 3/1989 | Wu | |
| 5,162,809 | A | 11/1992 | Wu | |
| 6,054,967 | A * | 4/2000 | Wu et al. | 343/909 |
| 6,822,622 | B2 * | 11/2004 | Crawford et al. | 343/909 |
| 7,071,889 | B2 * | 7/2006 | McKinzie et al. | 343/756 |
| 7,304,617 | B2 * | 12/2007 | Lynch | 343/909 |
| 7,405,698 | B2 * | 7/2008 | de Rochemont | 343/700 MS |
| 7,456,803 | B1 * | 11/2008 | Sievenpiper | 343/909 |
| 7,889,134 | B2 * | 2/2011 | McKinzie et al. | 343/700 MS |
| 8,098,213 | B2 * | 1/2012 | Kim et al. | 343/909 |

FOREIGN PATENT DOCUMENTS

| | | | |
|---|---|---|---|
| KR | 1999-0016811 | A | 3/1999 |
| KR | 2006-0118813 | A | 11/2006 |

* cited by examiner

*Primary Examiner* — Huedung Mancuso
(74) *Attorney, Agent, or Firm* — Rabin & Berdo, P.C.

(57) ABSTRACT

There is provided a frequency Selective Surface (FSS) structure for multi frequency bands configured with unit cells, each including a loop unit, arranged at regular intervals, wherein each unit cell includes: a dielectric layer; and the loop unit having a fixed width and formed on the dielectric layer, wherein the loop unit includes a first loop and a second loop formed inside the first loop with a predetermined space away from the first loop, each of the first loop and the second loop being formed sinuously in at least one portion.

12 Claims, 4 Drawing Sheets

FREQUENCY SELECTIVE SURFACE STRUCTURE FOR MULTI FREQUENCY BANDS

TECHNICAL FIELD

The present invention relates to a Frequency Selective Surface (FSS) structure for multi frequency bands; and, more particularly, to an FSS structure for multi frequency bands, in which FSS unit cell has a dual loop structure, each loop having a regularly sinuous pattern, such that frequency filtering can be performed by reflection and transmission with respect to multi frequency bands, and frequency separation is possible even when an interval between reflection frequencies is relatively narrow.

This work was supported by the IT R&D program of MIC/IITA [2007-S-020-02, "Development of Satellite and Terrestrial Convergence Technology for Internet Service on High-speed Mobile Vehicles"].

BACKGROUND ART

In general, FSS refers to a plane or surface where uniform patterns are periodically arranged to achieve frequency selective characteristics. Depending on the geometric structure of the uniform pattern, such as shape, size, length, width, etc., of the pattern and electric characteristics of a dielectric, FSS can transmit or cut off a certain frequency band. In FSS, a structure of uniform shape corresponding to a single cycle spatially is generally referred to as a unit cell. Frequency characteristics of FSS vary greatly depending on the shape, geometric structure, and size of an internal pattern of the unit cell, space between unit cells, and electric attributes of other dielectric matters. On the basis of the above principle, diverse methods have been studied to obtain desired frequency characteristics.

The existing FSS has a center connected structure, a loop structure, or other diverse structures. In particular, in order to design a figure geometrically constituting a unit cell to have a maximum length with respect to a given unit area, schemes for preventing, while bending loops in a complicate way, them from being entangled with each other have been proposed. In addition, there are a lot of structures suggested to use as much unit cell space as possible in order to increase space utilization.

Such FSS has the function of separating frequency bands, and therefore, it can be applied to a parabola antenna to accommodate multi frequency bands by one antenna system. The existing antenna systems without FSS can receive only frequencies f1 and f2 by feed horn, but the antenna system with FSS can further accept frequencies f3 and f4 as well as the frequencies f1 and f2.

Generally, FSS unit cells that have been widely used have the shape of rectangle, circle, rectangular loop, circular loop, or the like, and have different frequency response characteristics depending on the shape of each unit cell. However, one problem of the existing FSS is that it can separate frequencies only if the ratio of high frequency band to low frequency band is 1.5 or greater, and it cannot separate frequency bands if the ratio is below 1.5.

DISCLOSURE OF INVENTION

Technical Problem

It is, therefore, an object of the present invention to provide an FSS structure for multi frequency bands, in which FSS unit cell has a dual loop structure, each loop having a regularly sinuous pattern, such that frequency filtering can be performed by reflection and transmission with respect to multi frequency bands, and frequency separation is possible even when an interval between reflection frequencies is relatively narrow.

Other objects and advantages of the present invention can be understood by the following description, and become apparent with reference to the embodiments of the present invention. Also, it is obvious to those skilled in the art of the present invention that the objects and advantages of the present invention can be realized by the means as claimed and combinations thereof.

Technical Solution

In accordance with the present invention, there is provided a frequency Selective Surface (FSS) structure for multi frequency bands configured with unit cells, each including a loop unit, arranged at regular intervals, wherein each unit cell includes: a dielectric layer; and the loop unit having a fixed width and formed on the dielectric layer, wherein the loop unit includes a first loop and a second loop formed inside the first loop with a predetermined space away from the first loop, each of the first loop and the second loop being formed sinuously in at least one portion.

Advantageous Effects

As discussed below, the present invention is configured to let FSS unit cell have a dual loop structure, each loop having a regularly sinuous pattern, so that it enables filtering with respect to multi frequency bands, can separate frequency bands even when an interval between reflection frequencies is relatively narrow, and separate frequencies, without being sensitive to a change in incidence angle of electric wave.

BEST MODE FOR CARRYING OUT THE INVENTION

The advantages, features and aspects of the invention will become apparent from the following description of the embodiments with reference to the accompanying drawings, which is set forth hereinafter, and thus, the present invention will easily be carried out by those skilled in the art. Further, in the following description, well-known arts will not be described in detail if they could obscure the invention in unnecessary detail. Hereinafter, a preferred embodiment of the present invention will be described in detail with reference to the accompanying drawings.

Figure 1:
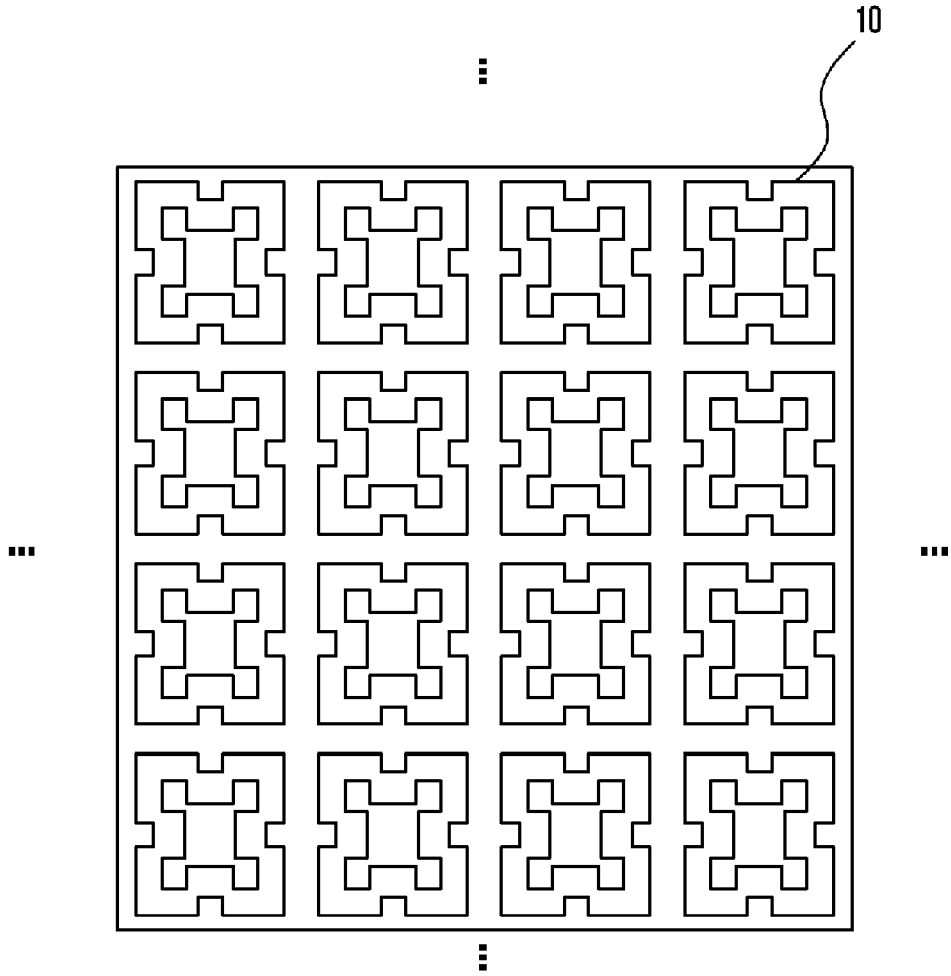
FIG. 1 is a view for explaining the entire structure of FSS in accordance with the present invention.
Figure 2:
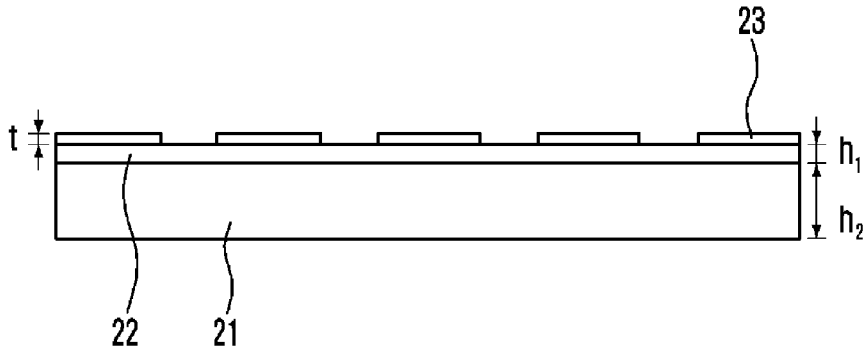
FIG. 2 is a cross-sectional view of FSS in accordance with the present invention.
Figure 3:
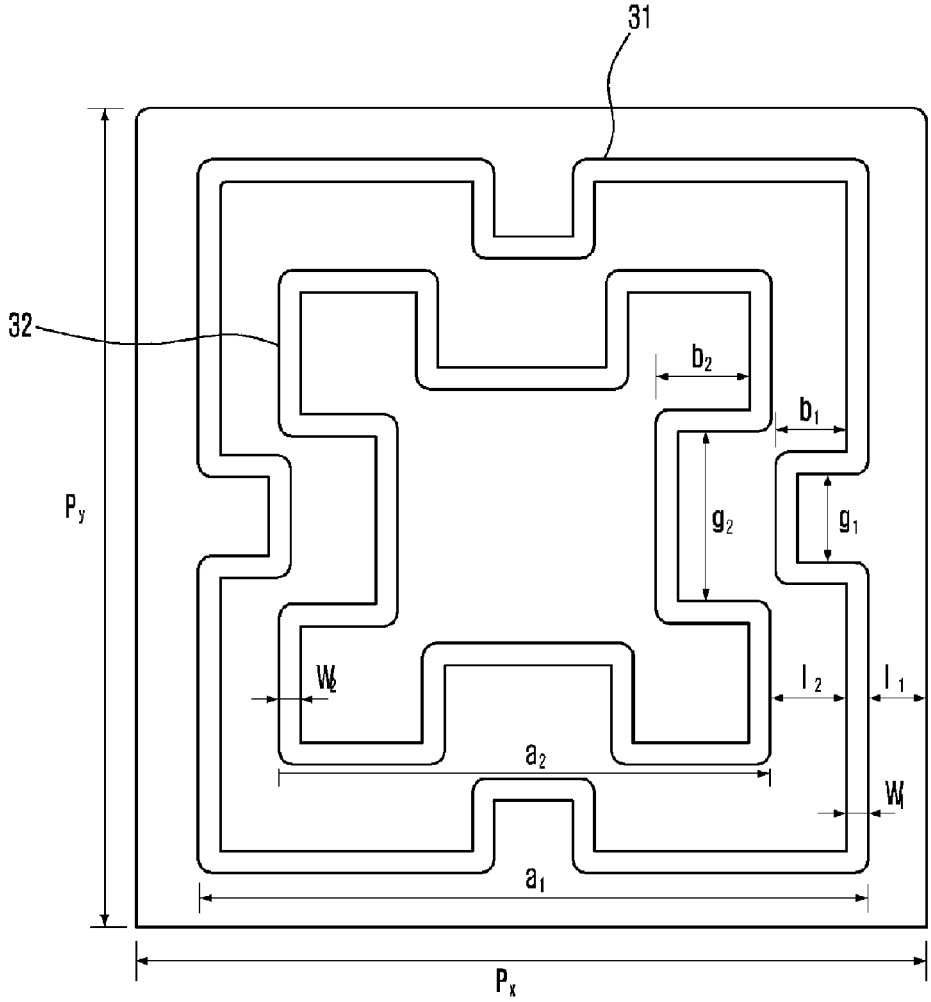
FIG. 3 is a detailed structural view of FSS unit cell in accordance with the present invention.

FIG. 1 is a view for explaining the arrangement state of FSS unit cells for multi frequency bands in accordance with the present invention, FIG. 2 is a cross-sectional view of FSS for multi frequency bands in accordance with the present invention, and FIG. 3 is a detailed structural view of FSS unit cell for multi frequency bands in accordance with the present invention.

Referring to FIG. 1, FSS of the present invention is configured in the form of an array of unit cells 10 having geometrically identical shape. In FIG. 1, each of the unit cells 10 has a dual loop structure consisting of a rectangular shaped outer loop and a rectangular shaped inner loop, in which the outer loop and the inner loop are separated by a fixed space and all four sides of both loops have a regularly sinuous pattern.

As shown in FIG. 2, FSS includes a first dielectric layer 21 having a predetermined dielectric constant; a second dielectric layer 22 which has a different dielectric constant from the first dielectric layer 21 and is formed into a an dielectric layer, such as a honeycomb or foam, to support a conductive thin film 23; and the conductive thin film 23 attached to the top of the second dielectric layer 22. Here, the loop of a regular pattern is formed by removing a part of the conductive membrane 23. That is to say, only the conductive thin film corresponding to the loop is removed so that the loop has a slot shape. Further, the loop is formed into a conductor by removing the remaining part, except the conductive thin film corresponding to the loop.

When the loop is formed in a slot shape, low frequency bands are all reflected while two high frequency bands are all transmitted. On the contrary, when the loop is formed into a conductor, low frequency bands are all transmitted while two high frequency bands are all reflected.

The dielectric layer is a structure to support the FSS conductive thin film. The dielectric should be selected to have a minimum thickness and low loss. A resonance frequency can be moved and lowered by this dielectric layer.

FIG. 3 is a view for explaining a detailed structure of unit cell in accordance with the present invention.

Referring to FIG. 3, the unit cell of FSS has a dual loop structure consisting of an outer loop 31 and an inner loop 32, both of which have a rectangular shape corresponding to each other. By bending four sides of each of the outer and the inner loops, the total length of the loop may be extended. As shown in FIG. 3, the outer loop and the inner loop have a slot shape made by etching a conductive thin film, and the remaining part excluding the loop is formed with the conductive thin film.

For example, suppose that frequency f1 (11.725 GHz) has a bandwidth of 2.05 GHz, frequency f2 (14.125 GHz) has a bandwidth of 750 MHz, frequency f3 (20.755 GHz) has a bandwidth of 800 MHz, and frequency f4 (30.485 GHz) has a bandwidth of 800 MHz.

FSS shown in FIG. 3 reflects all the frequencies f1 and f2 and transmits all the frequencies f3 and f4 at the same time. For the frequencies f1 and f2 reflected for the separation of frequency bands in this manner, the frequencies f1 and f2 are very close to each other and have a very large bandwidth, which cannot be reflected by a resonance phenomenon. Therefore, it is required that the loop slot be implemented to have a smaller size than wavelength such that all electric waves can be reflected by the conductive thin film. That is, the loop slot is designed to have a size suitable to reflect all frequencies having a lower band than the frequency f2.

Meanwhile, as for the frequencies f3 and f4 being transmitted next, all electric waves must be transmitted by using a resonance phenomenon by the rectangular slot loop. In FIG. 3, the outer loop 31 can be implemented to make the frequency f3 resonate, and the inner loop 32 can be designed to make the frequency f4 resonate, wherein the total length of each loop is related to the wavelength of a resonance frequency.

Using the existing two square shaped loops based on the characteristics of the loop of slot shape makes it possible to separate frequency bands. However, the square shaped loop structure can be used only if the ratio of the reflection frequency f2 to the transmission frequency f3 is 1.5 or greater. In other words, if the frequency ratio is below 1.5, frequency bands cannot be separated because of too small space between the frequencies f2 and f3.

To resolve this problem, the present invention is composed of a rectangular loop having its four sides bent, thereby reducing the size of a unit cell while extending the total length of the loop and letting it operate even for a circularly polarize wave.

Referring to FIG. 3, a cycle length, which is the unit cell size, $P_x=P_y$ is set smaller than ½ of the wavelength of the frequency f4, so that only fundamental waves can be propagated and scattered harmonic waves are not generated. In this slot shaped loop, length of one side, $a_1$, of the outer loop should be adjusted properly to reflect all of the frequencies f1 and f2 without any loss. At the same time, the loop length is subjected to micro-adjustment to let the sinuous portions, $b_1$ and $g_1$, in four sides of the outer loop resonate at the frequency f3. In case of the inner loop, its length $a_2$ is first adjusted to let it resonate at the frequency f4, and the sinuous portions $b_2$ and $g_2$ is subjected to micro-adjustment.

Table 1 below lists a concrete design specification of the unit cell shown in FIG. 3 for use in the FSS structure in accordance with the present invention. Here, foam is used for the dielectric layer. Since the influence of the foam on electric waves is insignificant, it is omitted.

TABLE 1

| | Parameter | | | | | | | | | | |
|---|---|---|---|---|---|---|---|---|---|---|---|
| | Px, Py | $a_1$ | $a_2$ | $l_1$ | $l_2$ | $w_1$ | $w_2$ | $g_1$ | $g_2$ | $b_1$ | $b_2$ |
| Length(mm) | 5 | 3.6 | 2.6 | 0.7 | 0.4 | 0.1 | 0.1 | 0.6 | 1.2 | 0.4 | 0.4 |

Figure 4:
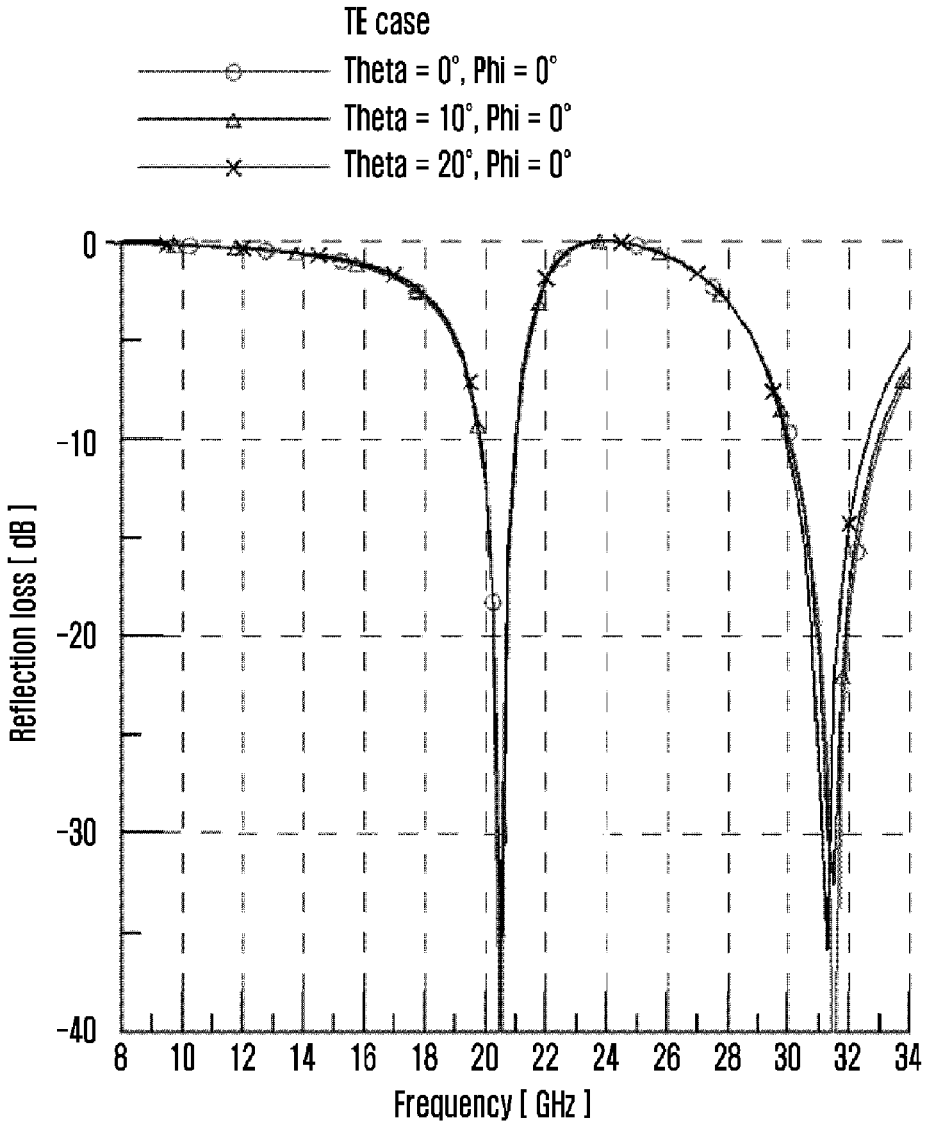
FIG. 4 is a graph showing reflection loss of FSS in accordance with the present invention.
Figure 5:
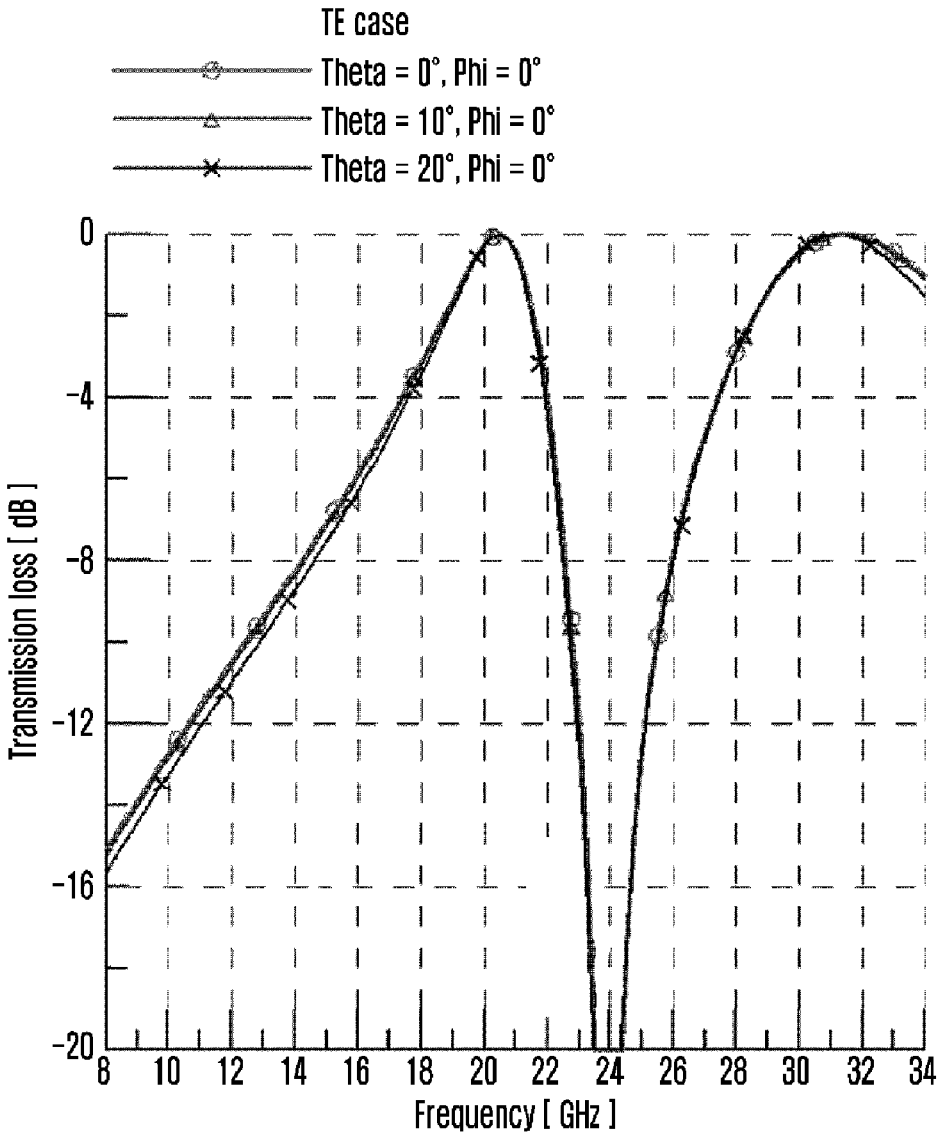
FIG. 5 is a graph showing transmission loss of FSS in accordance with the present invention.

FIG. 4 and FIG. 5 present calculated performance results for FSS that is designed as in Table 1. FIG. 4 shows reflection losses with respect to frequencies. As can be seen from FIG. 4, the frequencies f1 and f2 have a loss of about 0.8 dB, in which almost all of the incident waves are reflected. Referring to FIG. 4, it can be seen that reflection loss is very large in the frequency f3 of about 20 GHz and in the frequency f4 of about 30 GHz. This means that incident waves are not reflected but transmitted.

FIG. 5 graphically shows a transmission loss of incident waves when passing the FSS. Referring to FIG. 5, the transmission loss in the frequencies f3 and f4 is almost 0 dB, meaning that the frequencies are all transmitted without a loss.

As explained above, the FSS structure of the present invention can separate frequency bands by means of reflection and transmission if a frequency band width to be reflected is very large and if there are two frequency bands to be transmitted with a relatively narrow interval between the reflection frequency and the transmission frequency.

The present invention has been described with respect to the FSS structure having a slot shaped loop so far. However, if the loop is formed into a conductor, the frequency response characteristics of electric waves are opposite to the reflection and transmission characteristics shown in FIG. 4 and FIG. 5. That is, the FSS structure reflects all of the frequency f3 of about 20 GHz and the frequency f4 of about 30 GHz, while transmitting all the lower frequencies f1 and f2.

The present application contains subject matter related to Korean Patent Application No. 10-2007-0127739, filed in the Korean Intellectual Property Office on Dec. 10, 2007, the entire contents of which is incorporated herein by reference.

While the present invention has been described with respect to the specific embodiments, it will be apparent to those skilled in the art that various changes and modifications may be made without departing from the spirit and scope of the invention as defined in the following claims.

The invention claimed is:

1. A frequency Selective Surface (FSS) structure for multi frequency bands configured with unit cells, each including a loop unit, arranged at regular intervals, wherein each unit cell comprises:

a dielectric layer; and the loop unit having a fixed width and formed on the dielectric layer, wherein the loop unit includes a first loop and a second loop formed inside the first loop with a predetermined space away from the first loop, each of the first loop and the second loop being formed sinuously in at least one portion, wherein the first loop and the second loop are formed in a slot shape by removing a conductive thin film of a predetermined width.

2. The FSS structure of claim 1, wherein each of the first loop and the second loop has a rectangle shape and a part of four sides of each of the first loop and the second loop is formed in a sinuous pattern.

3. The FSS structure of claim 1, wherein the size of the unit cell has a value smaller than ½ of wavelength of a highest frequency among plural frequencies, such that only fundamental waves are propagated and scattered harmonic waves are not generated.

4. The FSS structure of claim 1, wherein reflection and transmission characteristics of a frequency are adjusted, depending on an interval between the first loop and the second loop, width and side length of each loop, and a curvature of each loop.

5. A frequency Selective Surface (FSS) structure for multi frequency bands configured with unit cells, each including a loop unit, arranged at regular intervals, wherein each unit cell comprises:

a dielectric layer; and the loop unit having a fixed width and formed on the dielectric layer, wherein the loop unit includes a first loop and a second loop formed inside the first loop with a predetermined space away from the first loop, each of the first loop and the second loop being formed sinuously in at least one portion, wherein the first loop and the second loop are formed into conductors by removing a conductive thin film formed on the dielectric layer, except for a portion corresponding to the loop.

6. The FSS structure of claim 5, wherein each of the first loop and the second loop has a rectangle shape and a part of four sides of each of the first loop and the second loop is formed in a sinuous pattern.

7. The FSS structure of claim 5, wherein the size of the unit cell has a value smaller than ½ of wavelength of a highest frequency among plural frequencies, such that only fundamental waves are propagated and scattered harmonic waves are not generated.

8. The FSS structure of claim 5, wherein reflection and transmission characteristics of a frequency are adjusted, depending on an interval between the first loop and the second loop, width and side length of each loop, and a curvature of each loop.

9. A frequency Selective Surface (FSS) structure for multi frequency bands configured with unit cells, each including a loop unit, arranged at regular intervals, wherein each unit cell comprises:

a dielectric layer; and the loop unit having a fixed width and formed on the dielectric layer, wherein the loop unit includes a first loop and a second loop formed inside the first loop with a predetermined space away from the first loop, each of the first loop and the second loop being formed sinuously in at least one portion, wherein the dielectric layer includes:

a first dielectric layer; and a second dielectric layer having a different dielectric constant from that of the first dielectric layer.

10. The FSS structure of claim 9, wherein each of the first loop and the second loop has a rectangle shape and a part of four sides of each of the first loop and the second loop is formed in a sinuous pattern.

11. The FSS structure of claim 9, wherein the size of the unit cell has a value smaller than ½ of wavelength of a highest frequency among plural frequencies, such that only fundamental waves are propagated and scattered harmonic waves are not generated.

12. The FSS structure of claim 9, wherein reflection and transmission characteristics of a frequency are adjusted, depending on an interval between the first loop and the second loop, width and side length of each loop, and a curvature of each loop.

* * * * *